United States Patent [19]

Nakao

[11] Patent Number: 4,976,477

[45] Date of Patent: Dec. 11, 1990

[54] DEVICE FOR LOCKING TRUNK LID OF MOTOR VEHICLE

[75] Inventor: Akihiro Nakao, Tokyo, Japan

[73] Assignee: Fuji Jukogyo Kabushiki Kaisha, Tokyo, Japan

[21] Appl. No.: 412,147

[22] Filed: Sep. 25, 1989

[30] Foreign Application Priority Data

Sep. 30, 1988 [JP] Japan ..... 63-128461

[51] Int. Cl.[5] ..... E05C 3/26

[52] U.S. Cl. ..... 292/201; 292/DIG. 43

[58] Field of Search ..... 292/201, DIG. 43, 341.16, 292/DIG. 29; 70/241

[56] References Cited

U.S. PATENT DOCUMENTS

| | | | |
|---|---|---|---|
| 2,943,880 | 7/1960 | Joachim et al. | 292/DIG. 43 X |
| 3,596,484 | 8/1971 | Peters | 292/DIG. 43 X |
| 4,762,348 | 8/1988 | Matsumoto | 292/201 |
| 4,796,932 | 1/1989 | Tame | 292/DIG. 43 X |
| 4,861,089 | 8/1989 | Compeau et al. | 292/201 X |
| 4,906,035 | 3/1990 | Nagai et al. | 292/DIG. 43 X |

*Primary Examiner*—Lloyd A. Gall

*Attorney, Agent, or Firm*—Beveridge, DeGrandi & Weilacher

[57] ABSTRACT

A motor vehicle trunk with a trunk lid locking device comprising a striker fixed to the lid, a striker receiving and locking mechanism, a motor for actuating this mechanism, and a control device for controlling the motor. The trunk has, in combination with the locking device, a trunk lamp, a trunk lamp switch, and means connected between the control device and its power supply and interlockingly coupling the opening and closing movement of the lid with the operation of the trunk lamp switch, whereby the trunk lamp is lit only when the trunk lid is opened, and the motor becomes operatable in response to the signal from a striker monitoring sensor only when the trunk lamp switch is in the state for extinguishing the trunk lamp.

4 Claims, 2 Drawing Sheets

DEVICE FOR LOCKING TRUNK LID OF MOTOR VEHICLE

BACKGROUND OF THE INVENTION

The present invention relates to an automatic device for locking the trunk lid of a motor vehicle.

Many motor vehicles have trunks with lids at their rear parts. A locking device is known which can be operated by a switch provided in the vehicle interior to unlock and release the trunk lid. One example is that disclosed in Japanese Laid Open Utility Model (Unexamined) Publication No. 65165/1984. When the switch is manipulated, it actuates a solenoid or a motor to swing a detent lever of the locking device. As a consequence, a striker is released from an engagement slot formed in a latch member. Thus the trunk lid to which the striker is attached is released.

With a conventional locking device, however, the action of closing the trunk lid is resisted by a number of reactionary forces. One of these forces is that required to compress the weather strip. Another is the reaction of the torsion spring for opening the trunk lid. Still another is the reaction of a spring which must be overcome by the striker in pressing into the engagement slot of the latch member to cause the latch member to rotate and thereby to engage with the detent lever.

Consequently, a great force must be applied to close the lid. This has given rise to problems such as difficulty in closing the lid.

Accordingly, there has previously been proposed an automatic device for locking lids of motor vehicles by which the force required to close the lids is reduced. In this prior device, as disclosed in Japanese Utility Model Application No. 30357/1988, a sensor is provided to detect the position to which the striker fits into the engagement slot provided in the latch member as the trunk lid is swung in closing motion. On the basis of a signal from this sensor, a motor is operated to rotate the latch member by way of a coupling member. At this time the striker is fitted in the engagement slot of the latch member. The latch member thus rotated forcibly moves the striker far into a guide slot formed in the base plate of the device. The latch member is thereby caught and stopped by the detent lever. Thus the lid closing force is reduced.

In spite of the improvements afforded by the above described locking device, the following problems remained.

When the trunk lid is closed, and the striker on the lid reaches the position for fitting into the engagement slot in the latch member, the sensor transmits a signal. In response to this signal the motor operates to rotate the latch member by way of a coupling member, thereby pressing the striker downwards. However, the striker monitoring sensor may respond to any of several objects other than the striker. For example, a foreign substance may be caught in a lock member such as the latch member or the detent lever during work such as loading or unloading of luggage into or out of the trunk with its lid opened. Another example is a person's finger accidently touching the sensor. Thus the locking device not only is undesirable on the point of safety since the striker monitoring sensor is operated by objects other than the striker, but has been accompanied by a problem that when only the latch member has moved to its locking position, that is, when the locking device has been placed in a so-called pseudo-locked state, the trunk lid is closed to cause damage or breakage of the locking mechanism.

SUMMARY OF THE INVENTION

It is an object of the present invention to provide a safe automatic trunk lid locking device for motor vehicles in which operational action leading to a pseudo-locked state is prevented.

According to the present invention, there is provided a device for locking a trunk lid of a motor vehicle comprising: a striker secured to said trunk lid; a base plate secured to a trunk of the vehicle and provided with a guide slot for receiving said striker when the lid is closed; a latch member rotatively supported on said base plate and provided with an engaging slot for functioning cooperatively with said guide slot to hold said striker; a detent lever pivotally supported on the base plate and being engageable with said latch member to hold the latch member in a locking position; a locking-/unlocking lever pivotally supported on the base plate for rotating the latch member into said locking position and alternately, by way of said detent lever, to rotate the latch member into an unlocking position; a motor for moving said locking/unlocking lever to any of three positions respectively for rotating the latch member to said locking position, a neutral position, and said unlocking position; control means for controlling said motor in the operation thereof; means for detecting arrival of the locking/unlocking lever at positions corresponding respectively to said locking position and said neutral position and transmitting respective corresponding detection signal to said control means; a striker monitoring sensor for detecting, during the opening or closing of the trunk lid, entrance of the striker into said engagement slot to transmit a corresponding detection signal to the control means; and an electric power source for operating said control device, said device further comprising a trunk switch which is closed when the trunk lid is open; and means for making the control means inoperative in receiving the detection signal from the striker monitoring sensor when the trunk switch is closed.

Preferred embodiments of the present invention will become understood from the following detailed description referring to the accompanying drawings.

DETAILED DESCRIPTION OF THE PREFERRED EMBODIMENTS

Figure 2:
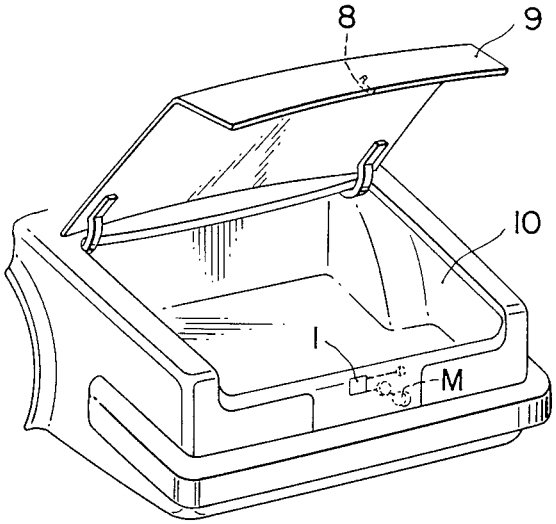
FIG. 2 is a perspective view showing the locking device installed on a trunk and its lid of a motor vehicle.

As shown in FIG. 2, the trunk lid locking device of the present invention has a base plate 1 secured to a rear edge part of a trunk structure 10 of a motor vehicle. The trunk structure 10 can be closed by a trunk lid 9.

Figure 1:
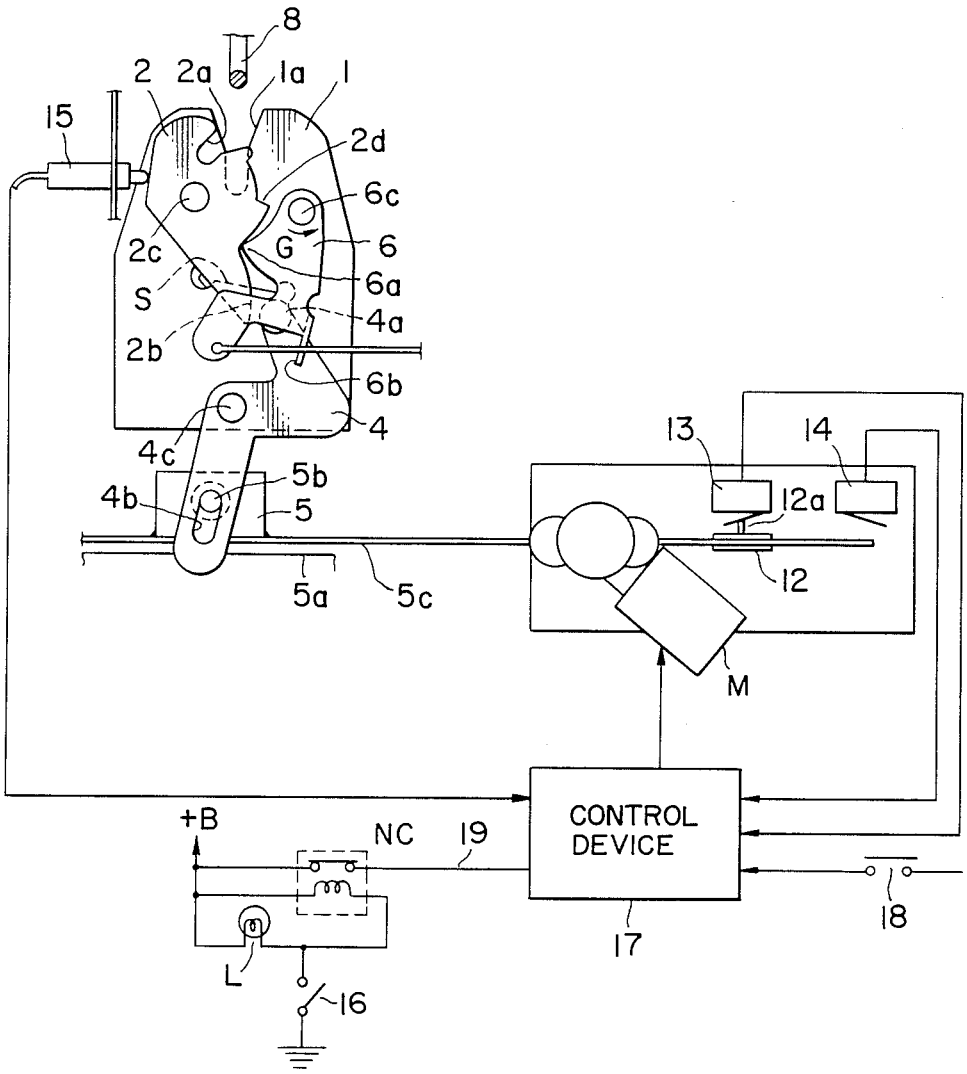
FIG. 1 is a general view of a device for locking a trunk lid of a motor vehicle according to the present invention.

As shown in FIG. 1, a guide slot la is formed in an upper part of the base plate 1 for guiding into a locked position a striker 8 secured to the rear edge of the trunk lid 9. A latch member 2 is pivotally supported by a pivot pin 2*c* fixed to the base plate 1. An engaging slot 2*a* formed in this latch member 2 functions cooperatively with the guide slot 1*a* to hold the striker 8 in the locked position. Furthermore, a detent lever 6 is pivotally supported by a pivot pin 6*c* on the base plate 1.

The detent lever 6 has a pawl part 6*a*, which engages with a catch part 2*d* of the latch member 2 to stop the rotation of the latch member 2. As is well known, the locked state is sustained by cooperative functioning of the engaging slot 2*a* and the guide slot 1*a*.

The latch member 2 and the detent lever 6 are connected by a tension spring S. This spring S exerts a spring force continually causing the pawl part 6*a* of the detent lever 6 to engage with the catch part 2*d* of the latch member 2.

A locking/unlocking lever 4 is pivotally supported by a pivot pin 4*c* on the base plate 1 near the lower edge thereof. The lever 4 constitutes a coupling mechanism together with a rod 5*c* described hereinafter. A roller 4*a* is rotatably supported on one end of the lever 4. A slot 4*b* is formed in the other end of the lever 4. The slot 4*b* is slidably engaged with a stud pin 5*b* projecting from and fixed to a sliding member 5. The sliding member 5 is fixed to the rod 5*c* and adapted to slide on and along a guide 5*a*.

The roller 4*a* of the locking/unlocking lever 4 is interposed between a contact surface 2*b* of the latch member 2 and a contact surface 6*b* formed by bending a part of the detent lever 6. By swinging the lever 4 about its pivot pin 4*c*, the contact surface 2*b* or the contact surface 6*b* is selectively pressed. The locking-/unlocking lever 4 is driven in its swinging movements by the reciprocal (left or right as viewed in FIG. 1) movement of the sliding member 5. The sliding member 5 is driven in turn by the reciprocal movement of the rod 5*c* driven by a motor M undergoing forward or reverse rotation.

The rod 5*c* is provided with a switch actuating member 12 fixed thereto. The switch actuating member 12 is adapted to actuate alternatively a neutral switch 13 and a full lock switch 14 depending on the position of the rod 5*c*. The neutral switch 13 indirectly detects the existence of the roller 4*a* at the central position between the above mentioned contact surfaces 2*b* and 6*b*. The full lock switch 14 indirectly detects whether or not the latch member 2 is in its locked position.

A striker monitoring sensor 15 is provided in abutting contact with the latch member 2. This sensor 15 monitors indirectly the engagement position of the striker 8 in the engaging slot 2*a* by detecting the rotation of the latch member 2. The signals respectively from the striker monitoring sensor 15, the neutral switch 13, the full lock switch 14, and an opener switch 18 within the vehicle interior are delivered into a control device 17. The control device 17 operates in response to these signals to transmit command signals such as forward rotation signal, reverse rotation signal, and stopping signal to the motor M.

The trunk structure 10 is provided with a trunk lamp L. When the trunk lid 9 is opened, a trunk lamp switch 16 is closed to light the trunk lamp L. When the trunk lid 9 is closed, the lamp switch 16 is opened to turn the lamp L off.

The electric power for operating the control device 17 is supplied thereto through a conductor line 19 connected by way of a normally-closed contact device NC to a power supply. This contact device NC is so connected that it is energized and opened by the closure of the trunk lamp switch 16.

The trunk lid locking device of the above described features according to the present invention operates in the following manner. As described hereinabove, when the trunk lid 9 is opened, the trunk lamp switch 16 is closed. The trunk lamp L is thereby lit. At the same time the normally-closed contact device NC is opened. Therefore the power supply to the control device 17 is cut off. Thus, even if a foreign matter or a piece of luggage contacts the striker monitoring sensor 15 and the sensor 15 becomes closed, the motor M and therefore the latch member 2 will not operate.

When the trunk lid 9 is closed, the trunk lamp switch 16 is opened. The trunk lamp L is thereby extinguished. At the same time, the normally-closed contact device NC assumes its closed state. Therefore, electric power is supplied from the power source to the control device 17. Thus the control device 17 is brought into operable state.

Accordingly, when the signal from the striker monitoring sensor 15 is supplied to the control device 17, the motor M operates on the basis of the signal from the striker monitoring sensor 15 and operates in accordance with signals from the neutral switch 13, the full lock switch 14, the vehicle interior opener switch 18, etc.

Figure 3:
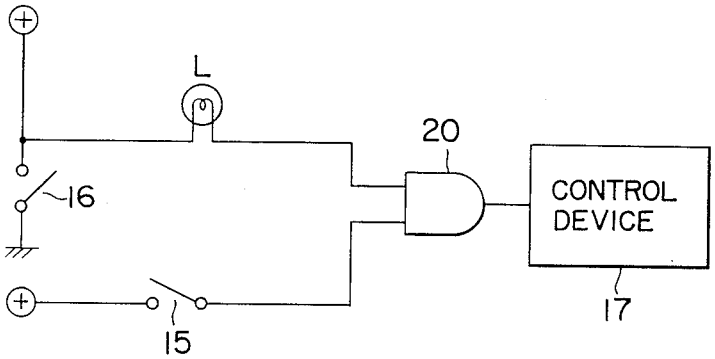
FIG. 3 is a circuit diagram showing a modification of the locking device of the present invention.

In a modification of the present invention as illustrated in FIG. 3, an AND circuit 20 is used in place of the normally-closed contact device NC of the preceding embodiment. By this arrangement, the signal outputted by the striker monitoring sensor 15 is transmitted to the control device 17 only when the trunk lamp switch 16 is opened. The locking device operates normally in accordance with signals from the neutral switch 13, the full lock switch 14, the interior opener switch 18, etc.

The trunk lid locking device of the present invention has the following effectiveness and features of merit.

A signal from the striker monitoring sensor 15 is transmitted to the control device 17 to enable the motor M to operate only when the trunk lamp switch 16 is open, that is, when the trunk lid 9 is closed. Accordingly, the latch member 2 is rotated. Therefore, the motor M will not operate even if a foreign object contacts the striker monitoring sensor 15 with the trunk lid 9 in its opened state. As a result there is no possibility of a person's finger or the like being caught and injured. Thus the locking device affords safety. Furthermore, the locking mechanism is prevented from damage or breakage due to closing of the trunk lid with the mechanism in a so-called pseudo-locked state wherein only the latch member is in locking state.

While the presently preferred embodiments of the present invention have been shown and described, it will be understood that the disclosure is for the purpose of illustration and that various changes and modifications may be made without departing from the scope of the invention as set forth in the appended claims.

What is claimed is:

1. A device for locking a trunk lid of a motor vehicle comprising: a striker secured to said trunk lid; a base plate secured to a trunk of the vehicle and provided with a guide slot for receiving said striker when the lid is closed; a latch member rotatively supported on said base plate and provided with an engaging slot for functioning cooperatively with said guide slot to hold said striker; a detent lever pivotally supported on the base plate and being engageable with said latch member to hold the latch member in a locking position; a locking-/unlocking lever pivotally supported on the base plate for rotating the latch member into said locking position and alternately, by way of said detent lever, to rotate the latch member into an unlocking position; a motor for moving said locking/unlocking lever to any of three positions respectively for rotating the latch member to said locking position, a neutral position, and said unlocking position; control means for controlling said motor in the operation thereof; means for detecting arrival of the locking/unlocking lever at positions corresponding respectively to said locking position and said neutral position and transmitting respective corresponding detection signal to said control means; a striker monitoring sensor for detecting, during the opening or closing of the trunk lid, entrance of the striker into said engaging slot to transmit a corresponding detection signal to the control means; and an electric power source for operating said control means, said device further comprising a trunk switch which is closed when the trunk lid is open; and means for making the control means inoperative in receiving the detection signal from the striker monitoring sensor when the trunk switch is closed.

2. The device for locking a trunk lid as claimed in claim 1, wherein said trunk switch is a trunk lamp switch for lighting a trunk lamp when it is closed.

3. The device for locking a trunk lid as claimed in claim 1, wherein said means for making the control means inoperative is normally closed contact means inserted between the power source and the control means, for being opened when the trunk switch is closed.

4. The device for locking a trunk lid as claimed in claim 1, wherein said means for making the control means inoperative is AND gate means having an output side connected to the control means and two input sides connected to the striker monitoring sensor and the trunk switch, respectively.

* * * * *